US008778101B2

(12) United States Patent
Mašek et al.

(10) Patent No.: US 8,778,101 B2
(45) Date of Patent: Jul. 15, 2014

(54) METHOD OF PRODUCTION OF STEEL SHEET PRESSED PARTS WITH LOCALLY MODIFIED PROPERTIES

(75) Inventors: Bohuslav Mašek, Kaznějov (CZ); Hana Jirková, Strakonice (CZ); Ludmila Kučerová, Pizeň (CZ); Andrea Ronešová, Pizeň (CZ); Stépàn Jeniček, Rotava (CZ)

(73) Assignee: Zapadoceska Univerzita V Plzni, Plzen (CZ)

( * ) Notice: Subject to any disclaimer, the term of this patent is extended or adjusted under 35 U.S.C. 154(b) by 140 days.

(21) Appl. No.: 13/438,495

(22) Filed: Apr. 3, 2012

(65) Prior Publication Data

US 2012/0273096 A1 Nov. 1, 2012

(30) Foreign Application Priority Data

Apr. 4, 2011 (CZ) ..... PV 2011-192

(51) Int. Cl.
*C21D 9/48* (2006.01)
*C21D 8/02* (2006.01)

(52) U.S. Cl.
USPC ..... 148/644; 148/649; 148/653; 148/654

(58) Field of Classification Search
CPC ..... C21D 9/48; C21D 8/02
USPC ..... 148/643, 644, 649, 653, 654
See application file for complete search history.

(56) References Cited

U.S. PATENT DOCUMENTS 5,916,389 A * 6/1999 Lundstrom ..... 148/640

OTHER PUBLICATIONS

Machine-English translation of DE 10012974, Schroeder, Matthias, Mar. 15, 2001.*

* cited by examiner

*Primary Examiner* — Deborah Yee
(74) *Attorney, Agent, or Firm* — Hovey Williams LLP

(57) ABSTRACT

According to the method of production of a steel sheet pressed part with locally modified properties, the steel sheet blank is first heated in a device for heating to the austenitic temperature of the material. Next, the steel sheet blank is converted in a tool for deep drawing by deformation into a final drawn part. Subsequently, the final drawn part is cooled inside the tool for deep drawing. Various locations of the final drawn part are cooled to various temperatures and/or at various rates during the cooling process. Thereafter, the drawn part is placed in an annealing device, where retained austenite stabilization occurs by diffusion-based carbon partitioning within the material from which the drawn part is made. After stabilization, the final drawn part is removed from the annealing device and air cooled to ambient temperature.

12 Claims, 4 Drawing Sheets

METHOD OF PRODUCTION OF STEEL SHEET PRESSED PARTS WITH LOCALLY MODIFIED PROPERTIES

This application claims the benefit of Czech Republic Application Serial No. PV 2011-192 filed Apr. 4, 2011, the entire disclosure of which is incorporated herein by reference.

BACKGROUND OF THE INVENTION

1. Field of the Invention

The present invention falls in the area of heat treatment of certain products, in particular deep-drawn metal sheet.

2. Description of the Prior Art

Spatially shaped parts from metal sheet are typically produced by deep drawing. This procedure is characterized in that a sheet with a suitable easy-to-deform microstructure is shaped and drawn over the edge of a female drawing die by a male punch, while being held typically by a blank holder. This drawing process may be carried out by other methods as well, e.g. by pressure exerted by a medium from one side or by an electromagnetic force. The shape of the product is governed by the shape of the tools. This process causes the material to harden due to cold deformation.

The higher the yield strength of the input stock, the greater is the springback effect. The springback causes problems with production precision and repeatability. This is why a new hot drawing process was introduced recently, which includes cooling of the formed part between the tools. This process involves processing of metal sheet which has been heated to the austenite region, then drawn while in the austenitic condition and then, thanks to rapid heat transfer to the female drawing die, cooled between the tools in such a way that hardening-type, i.e. martensititic, microstructure is obtained in the formed part. This leads to smaller dimensional variation caused by the springback effect. In some cases, a procedure is used wherein a spatially shaped cold-drawn part is heated to austenitic condition and then hardened between the tools without applying deformation.

A typical material used in this application is steel, for example a steel identified by Euronorm steel standards as 23MnB5, the strength of which is about 1,500 MPa upon quenching. Increasing the strength further by changing its alloying normally causes problems in achieving the required elongation values.

The safety components in automotive industry, in particular require the highest possible product of strength and elongation values, for the components to be able to absorb as large as possible amount of the impact energy upon crash by deforming with high flow stress and without premature instability or fracture failure. These requirements are met in part through suitable engineering design of the components and the use of metal sheets with unequal thickness.

The weakness of the solutions used so far is that the combination of strength and elongation of the formed steel part is uniform throughout its volume, regardless of any local functional requirements for the part. Where the desired properties are achieved simply by changing the thickness of the metal sheet, the resulting component becomes heavy and difficult to manufacture.

Said disadvantages are removed by the present invention.

SUMMARY OF THE INVENTION

This invention relates to a method of production of steel sheet pressed parts with locally modified properties. The locally modified properties include, in particular, strength and elongation.

As a first step of production of the steel sheet pressed part according to this invention, the steel sheet blank is heated in a device for heating to the austenitic temperature of the material, from which the blank was made. The austenitic temperatures of the materials used preferably range from approx. 727° C. to 1,492° C.

In a second step, the steel sheet blank is converted in a deep drawing tool by means of deformation into a final pressed part. The deformation inside the deep drawing tooling may take place in a press or through explosive forming or by forming with electromagnetic forces. In a third step, the final drawn part is cooled down inside the deep drawing tooling.

In real-world applications, a variant wherein ordering of the first and second step are interchanged can also be used. In such an embodiment, the steel sheet blank is converted into a final pressed part by deformation in the deep drawing tool at the first step.

In the second step of the alternate embodiment of the method, the final drawn part is heated in the device for heating to the austenitic temperature of the material from which the final drawn part is made. In a third step of the alternate embodiment of the method, the final drawn part is cooled down inside the deep drawing tooling.

In both variants of the method hereof, various locations of the final drawn part are cooled to various temperatures and/or at various rates during the cooling process. This arrangement enables areas with modified strength and elongation to be obtained in the drawn part.

In a following step, the final drawn part is placed in an annealing device. In the annealing device, retained austenite stabilization takes place by diffusion-based carbon partitioning within the material from which the final drawn part is made. The annealing device may have the form of a bath or furnace.

In a last step, the final drawn part is removed from the annealing device, once the stabilization finishes, and then the part is cooled down to ambient temperature in air.

After the final drawn part cools down to the ambient temperature, the method hereof may advantageously include an additional step wherein the excess edge of the final drawn part is trimmed using a laser, depending on precision requirements. This procedure provides for increased strength and elongation of the material, particularly in response to local requirements for individual components. In order to provide greater overall stability during deformation, the spatially shaped metal sheet drawn part shows locally differentiated properties in dependence on loading. For instance, the drawn part may exhibit high strength in certain locations, which provides high resistance to deformation. Along its edges, it may show higher elongation, which delays the onset of fracture and destruction. These properties can be altered by modifying the microstructure. This modification of the microstructure may be achieved particularly by controlled cooling during the deformation process and during quenching inside the tooling. Where the heat transfer rate is sufficient, the quenched state of microstructure, for example martensite, can be achieved. In locations with different requirements for microstructure, slow cooling can produce bainite or pearlite with ferrite, which are structures with lower strength but higher elongation. This can be achieved by either altering the thermal properties of the tool, wherein the tool will remove the heat from the blank non-uniformly, according to the requirements for microstructure, or by local cooling or heating of the tool. One of the possible variants is characterized by the blank being insulated from the tool or prevented from direct contact with the tool in locations where slow cooling is required.

In order to improve elongation in the area where the hardening-type microstructure is present, i.e. the location of the component with high strength, it is possible to use the Q-P process (Quenching and Partitioning). The Q-P process is a procedure, whereby the part is rapidly cooled to a temperature between the temperature at which martensite begins to form and the temperature at which transformation to martensite is finished. This causes the transformation of austenite to martensite to be incomplete. Part of austenite remains in the metastable state and is then enriched and therefore stabilized through diffusion-based redistribution of carbon. This takes place at temperatures slightly above the original temperature of the previous cooling step. After several minutes, the process of diffusion-based stabilization is finished and the product is cooled down to the ambient temperature. This process results in a microstructure which shows higher residual elongation than microstructures obtained by conventional procedures with comparable strength. The principle consists in formation of thin foils of plastic and ductile retained austenite along the boundaries of strong and hard martensite laths or plates. Under overload, retained austenite slows down catastrophic fracture propagation, causing residual elongation values to double, which may then reach above 10%. The finer the martensite particles, the better mechanical properties can be achieved by this procedure. As martensite forms within austenite upon cooling, the resulting microstructure will depend on the austenite grain size. In the course of conventional heat treatment, the size of grain increases during heating and, as a consequence, the size of resulting martensite particles increases. In order to refine these particles, the microstructure of retained austenite needs to be refined. This can only be achieved by forming at appropriate and sufficiently low temperatures in the fully austenitic region.

BRIEF DESCRIPTION OF THE DRAWINGS

An example embodiment of the proposed solution is described with reference to the drawings, wherein.

DETAILED DESCRIPTION OF THE PREFERRED EMBODIMENT

According to the present invention, a drawn part with locally modified properties is made from steel sheet.

Figure 1:
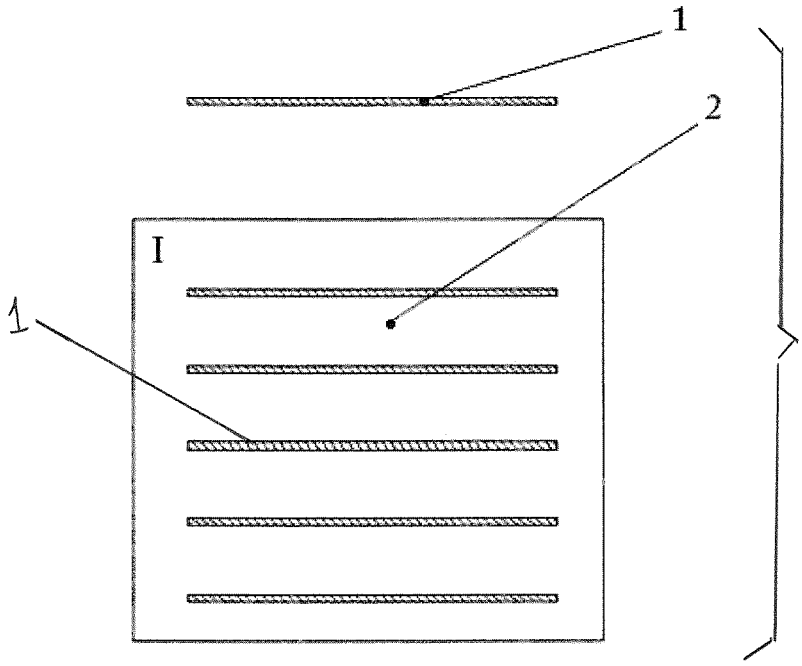
FIG. 1 is a vertical cross-sectional view showing steel sheet blanks being loaded into a device for heating.

At a first step shown in FIG. 1, a steel sheet blank 1, in this embodiment made from a steel alloy, for this example a steel having the nomenclature of 42SiCr using Euronorm steel standard nomenclature and having a chemical composition as set forth at Tab. 1, is loaded into and heated in the device for heating 2. In this embodiment, the device for heating 2 may be a furnace. The steel sheet blank 1 is heated to an austenitic temperature, in the example steel alloy described in this embodiment to about 920° C.

Figure 2:
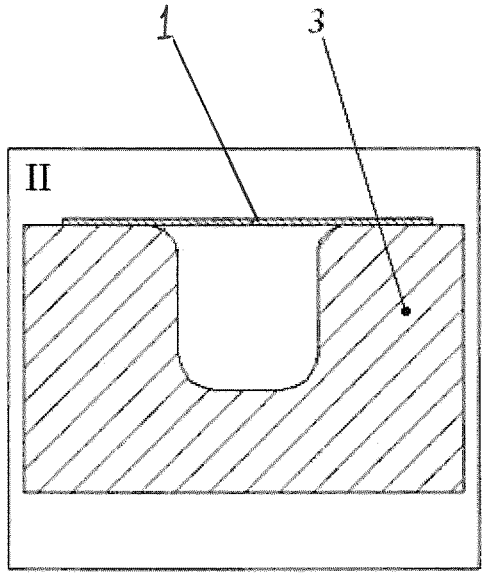
FIG. 2 is a vertical cross-sectional view showing a steel sheet blank positioned on a forming device, here a deep drawing tool, prior to deformation of the steel sheet blank into a final drawn part.

At the second step as illustrated in FIG. 2, the steel sheet blank 1 has been transferred from the device for heating 2 to a forming device, which in this embodiment may be a press, where it is formed in a tool 3 for deep drawing to obtain the shape of the final drawn part 4 (see FIGS. 3-7). The deformation in this embodiment takes place preferably at a temperature between about 900° C. and about 420° C.

Figure 3:
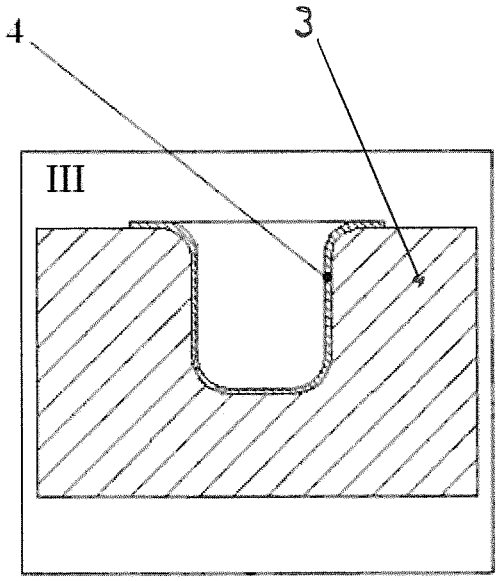
FIG. 3 is a vertical cross-sectional view similar to FIG. 2 but showing the forming device after deformation of the steel sheet blank into the final drawn part.

In a third step as illustrated in FIG. 3, the material of the final drawn part 4 is cooled intensively in places which are in direct contact with the wall of the tool 3 for deep drawing. The tool 3 for deep drawing, shown in greater detail in FIG. 7, preferably comprises a bottom part 5 and a top part 6, which are separated by insulation 10. The bottom part 5 of the tool 3 for deep drawing is preferably heated to about 200° C. in this example. The area of the final drawn part 4, which is in direct contact with the bottom part 5 of the tool 3 for deep drawing, is initially cooled down from the original temperature to preferably about 200° C. in this embodiment. By this means, a part of the final drawn part 4 undergoes incomplete transformation of austenite into martensite where the resulting material contains about 10% metastable austenite.

The top part 6 of the tool 3 for deep drawing is preferably heated to about 550° C. The area of the final drawn part 4, which is in direct contact with the top part 6 of the tool 3 for deep drawing, is cooled down from the original temperature to preferably about 550° C. in this embodiment. By this means and thanks to slower cooling, the microstructure in this area of the final drawn part 4 transforms into bainite, pearlite-ferrite or their mixture.

Figure 4:
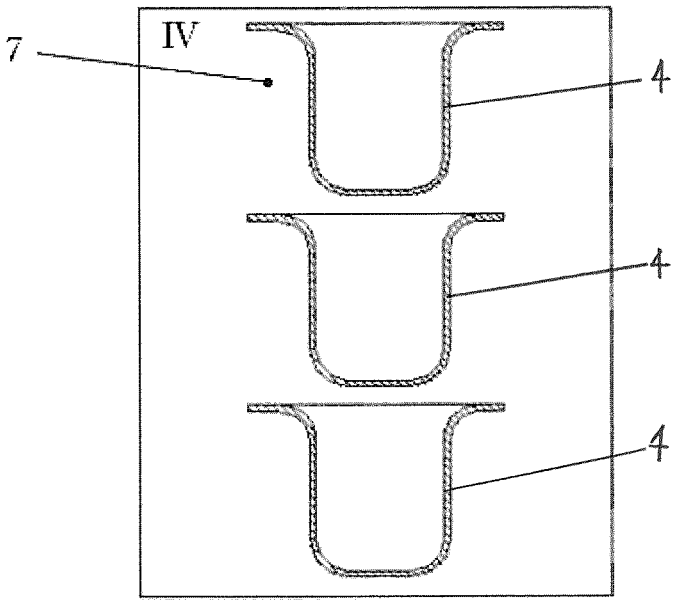
FIG. 4 is a vertical cross-sectional view showing a plurality of final drawn parts being annealed in an annealing device.

In a following step illustrated in FIG. 4, the final drawn part 4 is placed in an annealing device 7. In this embodiment, the annealing device 7 has the form of a bath preferably at about 250° C. The temperature of 250° C. is required for stabilizing austenite over the course of 10 minutes for the identified steel alloy of this embodiment.

Figure 5:
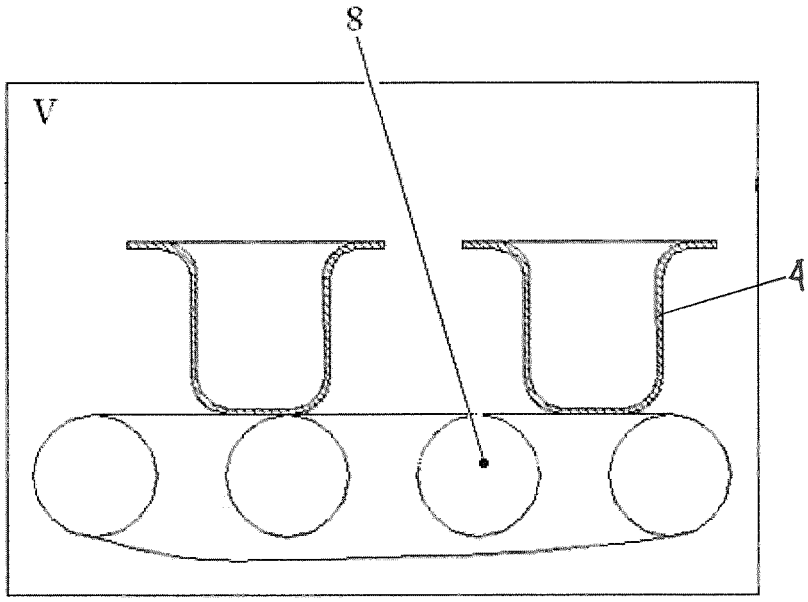
FIG. 5 is a vertical cross-sectional view showing a plurality of final drawn parts positioned on a cooling device, here a cooling conveyor.

After the stabilization is finished, the following step illustrated in FIG. 5 includes a removal of the final drawn part 4 from the annealing device 7 and its cooling down in air to ambient temperature on a cooling device, for example a cooling conveyor 8 in a final cooling step.

Figure 6:
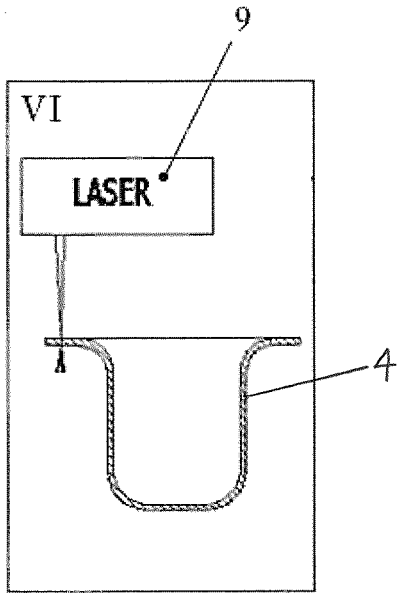
FIG. 6 is a vertical cross-sectional view showing the use of a laser cutter to trim excess edge material from the final drawn part.
Figure 7:
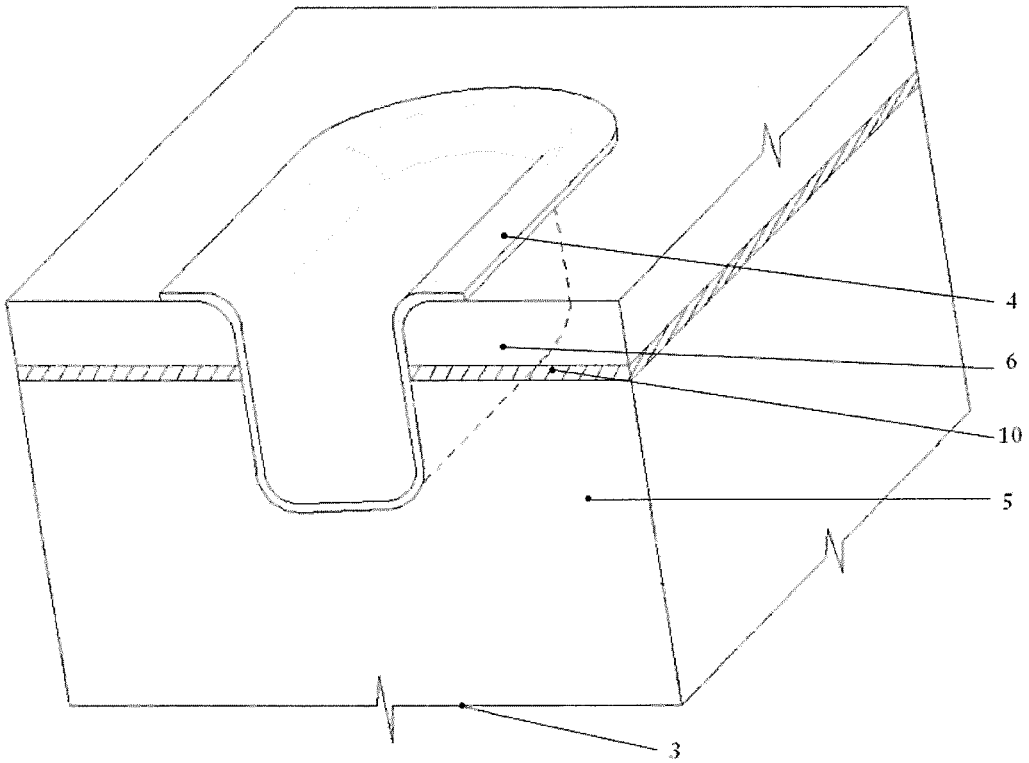
FIG. 7 is an enlarged isometric view in partial vertical cross-section showing a drawn part positioned in a deep drawing tool and details of the tool.

In a last step as shown in FIG. 6, the excess edges 11 of the final drawn part 4 may be trimmed by a laser 9 to obtain the required contour and finished edges.

Said procedure may be used for making a car body pillar showing a large product of values of strength and elongation and capable to absorb the highest possible amount of impact energy in a crash by deforming at high flow stress and without premature instability or fracture failure.

TABLE 1

| Chemical composition of the material 42SiCr (wt. %) | | | | | | | | | | | | |
|---|---|---|---|---|---|---|---|---|---|---|---|---|
| Fe | C | Si | Mn | Cr | Mo | Al | Nb | P | S | Ni | Cu | Sn |
| 95.389 | 0.43 | 2.03 | 0.59 | 1.33 | 0.03 | 0.008 | 0.03 | 0.009 | 0.004 | 0.07 | 0.07 | 0.01 |

As noted above, formation of the final drawn part 4 may alternatively be accomplished by a process wherein some of the aforementioned steps are re-ordered. For example, the sheet steel blank 1 may first be placed in a forming device such as a press having a deep drawing tool 3 and deformed by deep drawing into the shape of a final drawn part 4. Thereafter, the final drawn part 4 may be heated in the device for heating 2 to a temperature whereby the material of the final drawn part 4 reaches an austenitic temperature. Thereafter, the final drawn part 4 may be cooled down inside the deep drawing tool 3. The temperatures in different parts of the deep drawing tool 3 may be cooled to different temperatures as noted above. By way of example, for the alloy 42SiCr noted above, the bottom part 5 of the tool 3 maybe cooled to about 200° C. while the top part of the tool 3 may be cooled to about 550° C., resulting in various locations of the final drawn part being cooled to different temperatures and/or at different rates during the cooling process. Thereafter, the final drawn part 4 may undergo an annealing process wherein the final drawn part 4 is placed in an annealing device 7. In the annealing step, retained austenite stabilization takes place by diffusion-based carbon partitioning within the material from which the final drawn part 4 is made. After completion of the annealing process to the point wherein the material of the final drawn part 4 substantially completes the retained austenite stabilization, the final drawn part 4 is removed from the annealing device and in a final cooling step, the temperature of the final drawn part 4 is cooled down in the air to ambient air temperatures, typically about 20° C. Like in the first embodiment of the process, the edges of the final drawn part 4 may be trimmed with, for example, laser to remove excess edges and undesired excess material from the edges of the final drawn part 4.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirt of the present invention.

The inventors hereby state their intent to rely on the Doctrine of Equivalents to determine and assess the reasonably fair scope of their invention as pertains to any apparatus or method not materially departing from but outside the literal scope of the invention as set out in the following claims.

| List of reference symbols | |
|---|---|
| 1 | steel sheet blank |
| 2 | device for heating |
| 3 | tool for deep drawing |
| 4 | final drawn part |
| 5 | bottom part of tool |
| 6 | top part of tool |
| 7 | annealing device |
| 8 | cooling conveyor |
| 9 | laser for trimming the excess edges |
| 10 | insulation |

The invention claimed is:

1. A method of production of a steel sheet pressed part with locally modified properties, comprising the steps of:

heating a steel sheet blank in a heating device in a first production step to the austenitic temperature of the material from which the blank is made;

thereafter converting the steel sheet blank in a tool for deep drawing by deformation into a final drawn part;

thereafter initially cooling the final drawn part inside the tool for deep drawing such that various locations of the final drawn part are cooled to various temperatures and/or at various rates during the cooling step, wherein a part of the final drawn part undergoes incomplete transformation of austenite into martensite, such that the final drawn part comprises retained austenite;

thereafter placing the final drawn part in an annealing device and annealing the final drawn part under conditions whereby retained austenite stabilization takes place by diffusion-based carbon partitioning within the material from which the final drawn part is made; and removing the final drawn part from the annealing device and then cooling down in a final cooling step in air to ambient temperature.

2. The method of production of claim 1 for making a steel sheet pressed part wherein after cooling of the final drawn part to ambient temperature, excess edges of the final drawn part are trimmed with a laser.

3. A method of production of a steel sheet pressed part with locally modified properties, comprising the steps of:

converting of a steel sheet blank into a final drawn part by deformation of the sheet steel blank in a tool for deep drawing;

thereafter heating the final drawn part in a device for heating the final drawn part to the austenitic temperature of the material, from which the final drawn part is made;

thereafter initially cooling the final drawn part inside the tool for deep drawing such that various locations of the final drawn part are cooled to various temperatures and/or at various rates during the initial cooling process, wherein a part of the final drawn part undergoes incomplete transformation of austenite into martensite, such that the final drawn part comprises retained austenite;

thereafter placing the final drawn part in an annealing device and annealing the final drawn part under conditions where retained austenite stabilization takes place by diffusion-based carbon partitioning within the material from which the final drawn part is made; and removing the final drawn part from the annealing device and then cooling down in air to ambient temperature.

4. The method of production of claim 3 for making a steel sheet pressed part wherein after cooling of the final drawn part to ambient temperature, excess edges of the final drawn part are trimmed with a laser.

5. The method of production of claim 1 for making a steel sheet pressed part, wherein the initial cooling comprises cooling down the final drawn part to a temperature between the temperature at which martensite begins to form and the temperature at which martensite formation is finished.

6. The method of production of claim 1 for making a steel sheet pressed part, wherein part of the austenite remains in the metastable state in the final drawn part after the initial cooling.

7. The method of production of claim 1 for making a steel sheet pressed part, wherein the final drawn part after the final cooling step comprises plastic and deformable retained austenite along the boundaries of strong and hard martensite.

8. The method of production of claim 1 for making a steel sheet pressed part, wherein after cooling of the final drawn part to ambient temperature, said final drawn part has locally differentiated properties of high strength or high elongation in certain locations.

9. The method of production of claim 3 for making a steel sheet pressed part, wherein the initial cooling comprises cooling down the final drawn part to a temperature between the temperature at which martensite begins to form and the temperature at which martensite formation is finished.

10. The method of production of claim 3 for making a steel sheet pressed part, wherein part of the austenite remains in the metastable state in the final drawn part after the initial cooling.

11. The method of production of claim 3 for making a steel sheet pressed part, wherein the final drawn part after the final cooling step comprises plastic and deformable retained austenite along the boundaries of strong and hard martensite.

12. The method of production of claim 3 for making a steel sheet pressed part, wherein after cooling of the final drawn part to ambient temperature, said final drawn part has locally differentiated properties of high strength or high elongation in certain locations.

* * * * *